US007563053B2

(12) United States Patent
Tyhy et al.

(10) Patent No.: US 7,563,053 B2
(45) Date of Patent: Jul. 21, 2009

(54) ROLLER ASSEMBLY

(75) Inventors: Gary Tyhy, Winnipeg (CA); Alan Titheridge, Winnipeg (CA); Kevin Tyhy, Winnipeg (CA); Hilmar Agostinho, Winnipeg (CA); David Wallwin, Winnipeg (CA)

(73) Assignee: Minic Industries Limited, West St. Paul, CA (US)

( * ) Notice: Subject to any disclaimer, the term of this patent is extended or adjusted under 35 U.S.C. 154(b) by 347 days.

(21) Appl. No.: 11/516,483

(22) Filed: Sep. 7, 2006

(65) Prior Publication Data

US 2007/0206993 A1 Sep. 6, 2007

Related U.S. Application Data

(60) Provisional application No. 60/778,906, filed on Mar. 6, 2006.

(51) Int. Cl.
*A01B 29/06* (2006.01)
*E01C 19/29* (2006.01)
*E01C 19/27* (2006.01)

(52) U.S. Cl. ..... 404/126; 404/122; 404/125; 404/128; 172/684.5

(58) Field of Classification Search ..... 404/122–129; 172/797, 799.5, 684.5
See application file for complete search history.

(56) References Cited

U.S. PATENT DOCUMENTS 1,804,862 A 5/1931 Duncan et al.
2,455,636 A * 12/1948 Woolson ..... 89/1.13
3,119,313 A 1/1964 Neidhardt et al.
3,291,013 A 12/1966 Stolp
3,401,611 A * 9/1968 Schneider ..... 404/128
3,993,413 A 11/1976 Cox et al.
4,333,665 A 6/1982 Haddock
4,438,819 A 3/1984 Ryals
4,909,663 A 3/1990 Freeman
5,215,150 A 6/1993 Wilkins
5,395,182 A 3/1995 Rossburger
5,738,379 A 4/1998 Floe
5,896,820 A 4/1999 Klinker et al.
6,119,792 A 9/2000 Almer
6,206,106 B1 3/2001 Heckendorf
6,520,717 B1 2/2003 Otto et al.
6,607,330 B2 * 8/2003 Philpott ..... 404/132

OTHER PUBLICATIONS

Handy Hitch Mfg. Inc. brochure, Jun. 2004, The Best Concept in Packer/Roller Design.

* cited by examiner

*Primary Examiner*—Raymond W Addie
(74) *Attorney, Agent, or Firm*—Ade + Company Inc.; Ryan W. Dupuis; Kyle R. Scotterthicade

(57) ABSTRACT

A roller assembly is provided for connection behind a towing vehicle, for example a road grader vehicle. The roller assembly includes a frame supporting a plurality of walking beams extending generally in the forwarding working direction of the grader with packing rollers supported at each end thereof. Each walking beam is centrally pivoted on a support arm which is in turn pivoted on the frame to permit each pivot of each walking beam to be moveable generally upwardly and downwardly in relation to the pivots of the other walking beams. A common hydraulic circuit is arranged to provide a common downward force to the pivots of the walking beams. Pivoting movement of the walking beams accommodates for varying ground contours in the longitudinal direction while independent upward and downward movement of the walking beam pivots relative to one another permits accommodation of varying ground contours in the lateral direction.

20 Claims, 6 Drawing Sheets

ROLLER ASSEMBLY

This application claims the benefit under 35 U.S.C. 119(e) of U.S. provisional application Ser. No. 60/778,906, filed Mar. 6, 2006.

FIELD OF THE INVENTION

The present invention relates to a roller assembly, and more particularly relates to a roller assembly of the type for being towed behind a towing vehicle for packing the ground across which the roller assembly is towed.

BACKGROUND

In the construction of roadways and the like, it is common practice to make use of materials such as gravel or small stones as paving materials. These materials can either be used alone or as a base material for other surfaces such as asphalt and concrete. It is further known that quality and durability of the finished paving requires that the base layer be compact to provide a relatively uniform base surface using grading equipment followed by rollers or packers in various configurations.

U.S. Pat. No. 5,395,182 to Rossburger, U.S. Pat. No. 6,119,792 to Almer, U.S. Pat. No. 4,909,663 to Freeman, U.S. Pat. No. 3,993,413 to Cox et al., U.S. Pat. No. 3,291,013 to Stolp and U.S. Pat. No. 3,119,313 to Neidhardt et al. disclose various examples of roller and packer assemblies. In general these assemblies offer minimal relative movement between the wheels or rollers of the assembly to accommodate for obstacles or various ground contours, or alternatively a complex mechanism of bearings and pivoting parts is required in order to achieve a desired degree of relative movement between the rollers.

U.S. Pat. No. 6,520,717 to Otto et al. discloses a walking beam type roller apparatus in which a simplified mechanism of walking beams permits some relative movement between individual pairs of front and rear rollers to accommodate for obstacles or various ground contours in the longitudinal working direction of the apparatus. The walking beams however are pivotally connected along a common fixed pivot axis so that the apparatus is very limited in its ability to accommodate for any differences in ground contours in a lateral direction.

Another walking beam type roller apparatus made available by Handy Hitch Manufacturing Inc. of West St. Paul, Manitoba, Canada involves a plurality of walking beams supported on two laterally oriented support members which are in turn supported on a common frame for towing behind a grader vehicle. On each support member, each walking beam pivot axis is fixed in relation to the pivot axes of the other walking beams which prevents the walking beams from fully accommodating differences in ground contours in the lateral direction.

SUMMARY OF THE INVENTION

According to one aspect of the invention there is provided a roller assembly for movement along the ground in a forward working direction; the assembly comprising:

a frame member extending transversely to the forward working direction;

a plurality of walking beams, each walking beam extending generally in the forward working direction between opposed ends.

a pivot on each walking beam between the opposed ends thereof pivotally supporting the walking beam about a respective generally horizontal pivot axis oriented transversely to the forward working direction;

a roller rotatably supported at each end of each walking beam for rolling movement along the ground in the forward working direction;

a support mechanism supporting the pivots of the walking beams on the frame member such that some pivots are movable generally upwardly and downwardly relative to one another.

According to a second aspect of the present invention there is provided a roller assembly for movement along the ground in a forward working direction; the assembly comprising:

a frame member extending transversely to the forward working direction;

a plurality of walking beams, each walking beam extending generally in the forward working direction between opposed ends.

a pivot on each walking beam between the opposed ends thereof pivotally supporting the walking beam about a respective generally horizontal pivot axis oriented transversely to the forward working direction;

a roller rotatably supported at each end of each walking beam for rolling movement along the ground in the forward working direction;

a support mechanism supporting the pivots of the walking beams on the frame member such that each pivot is supported for independent upward and downward deflections relative to other ones of the pivots.

By providing both walking beams supporting the rollers and a mechanism to support the pivots of the walking beams for generally up and down movement relative to one another, a very flexible roller assembly is achieved which accommodates variations in contours both in the longitudinal working direction and in a lateral direction between the rollers using a very simplified mechanism of pivots which is durable while also being easy and of low cost to manufacture and maintain.

Each pivot is preferably supported for independent upward and downward deflections relative to the other pivots and relative to the frame member.

The support mechanism may be arranged to support pivot axes of the pivots in a horizontal orientation throughout their upward and downward movement relative to one another.

Preferably the support mechanism includes a hydraulic system for applying a common downward hydraulic pressure to the pivots of the walking beams and alternatively for commonly raising the pivots of the walking beams relative to the frame member.

The support mechanism may comprise a support arm associated with each walking beam, in which the support arm is pivotally supported on the frame member at a front end and supports the pivot of the respective walking beam thereon spaced rearward from the front end.

A hydraulic actuator is preferably associated with each support arm for applying a downward force of hydraulic pressure to each pivot of each walking beam.

The actuators may be provided with a common hydraulic pressure, in communication with a common hydraulic fluid accumulator arranged to commonly receive hydraulic fluid from the actuators when actuated, and in communication with a common pressure relief mechanism arranged to commonly release pressure to all of the actuators when actuated.

There may be provided a hitch member arranged to connect to a towing vehicle and a steering pivot coupling the frame member to the hitch member for relative pivotal movement of the frame member relative to the hitch member about a generally vertical steering axis.

The vertical steering pivot is preferably coupled to the main frame member for relative sliding movement in a lateral direction. A hydraulic actuator may be coupled between the steering pivot and the frame member for controlling relative sliding movement therebetween, in the lateral direction, transversely to the forward working direction.

In some embodiments, a single roller can be supported at each end of each walking beam, however in alternate embodiments there may be provided a plurality of rollers supported at each end of each walking beam. In either instance all of the rollers are preferably offset from one another in a lateral direction.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
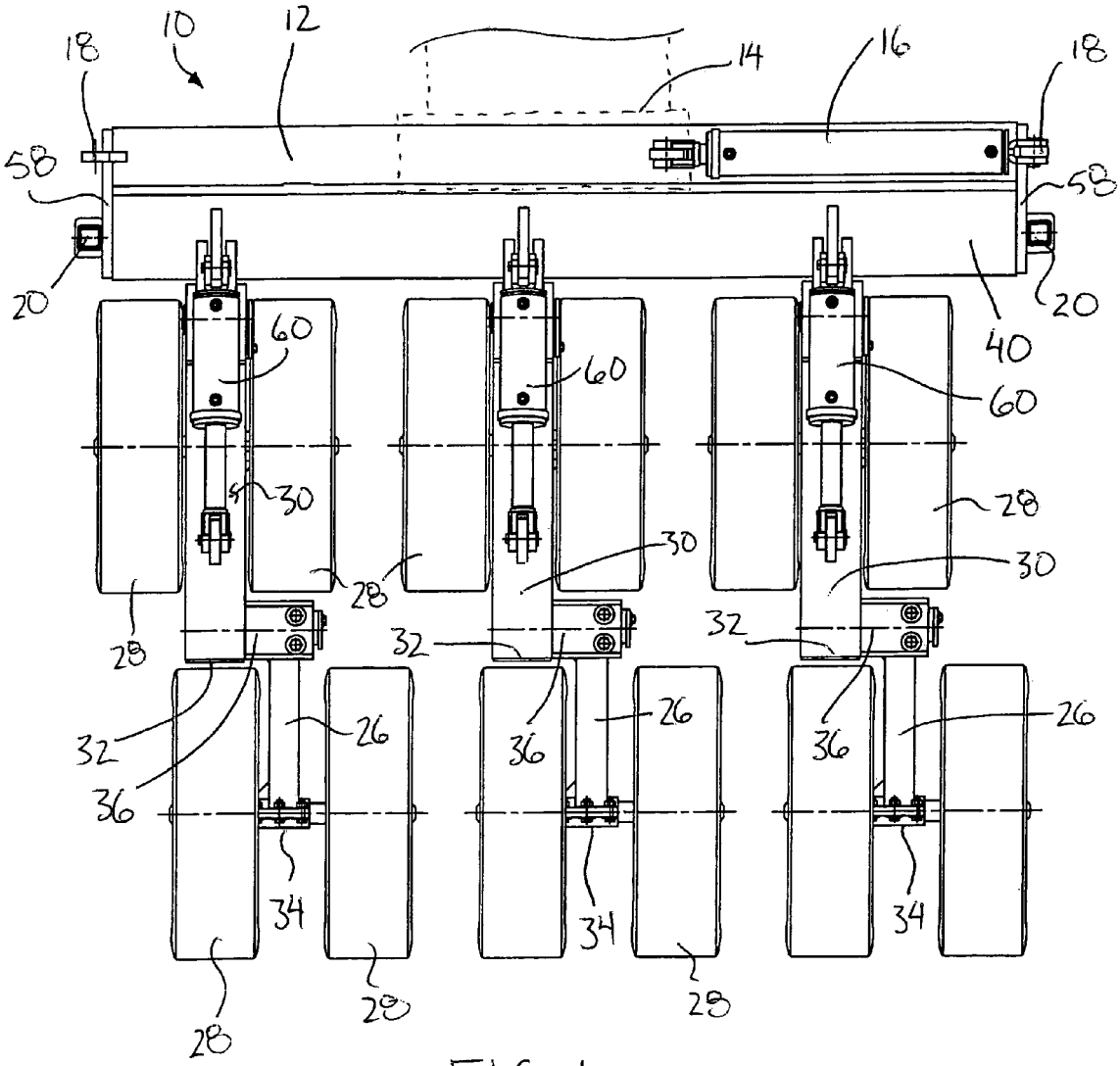
FIG. 1 is a top plan view of a roller assembly.
Figure 2:
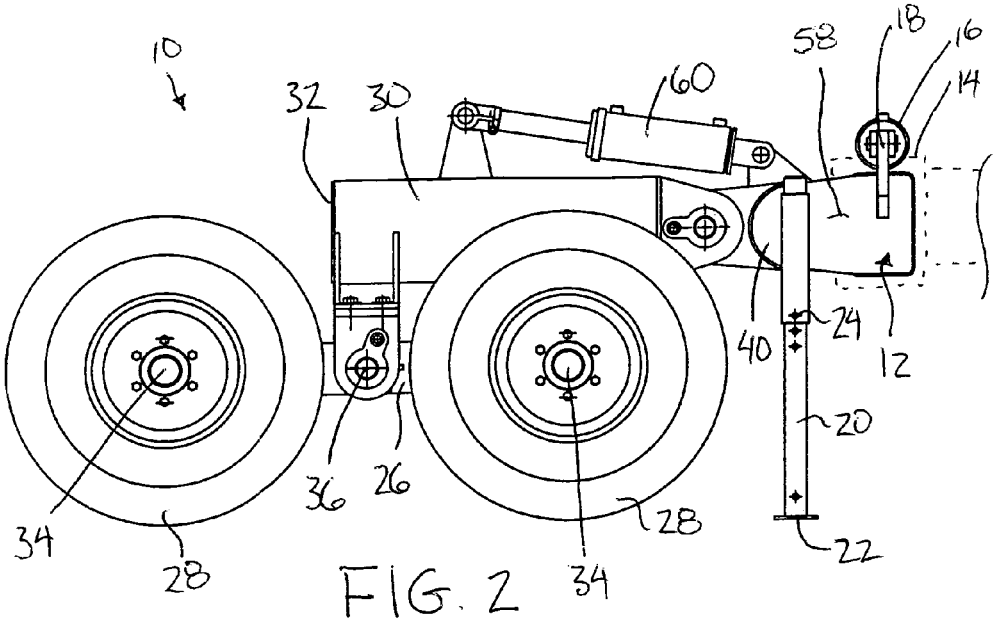
FIG. 2 is a side elevation view of the assembly according to FIG. 1 in a level position of the walking beams.
Figure 3:
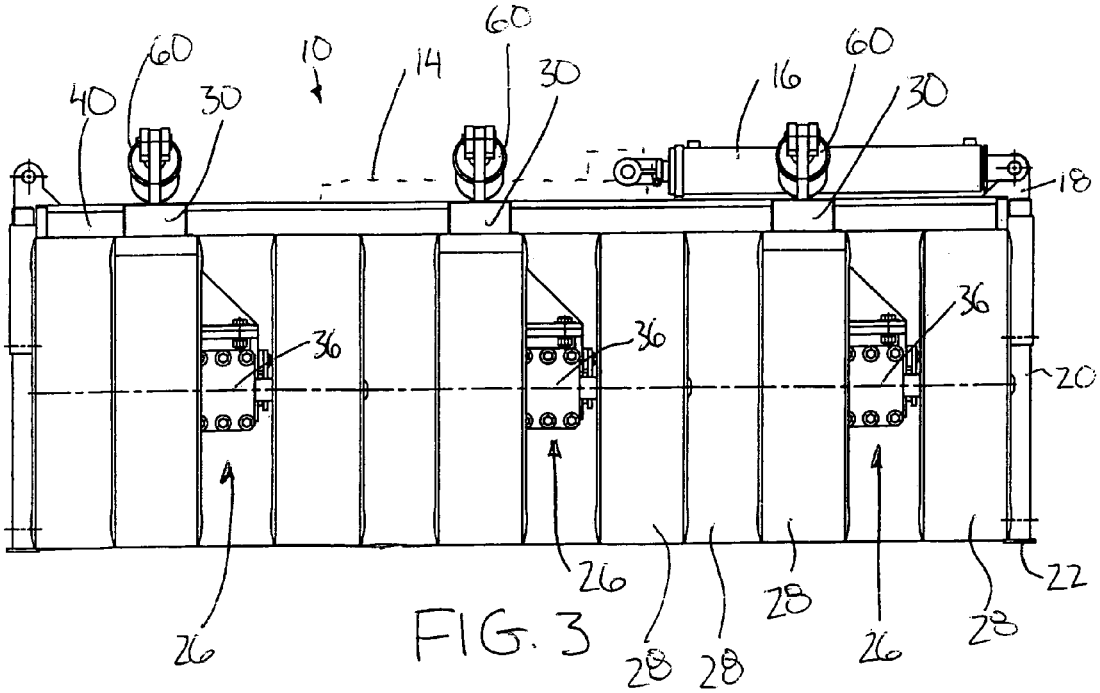
FIG. 3 is a rear elevational view of the assembly according to FIG. 1 in which the rollers are shown in a level position.

Referring to the accompanying figures there is illustrated a roller assembly generally indicated by reference numeral 10. The assembly 10 is particularly suited for packing various materials on the ground, and more particularly is suited for being towed behind a grader vehicle for packing gravel or earth to be made level by the grader vehicle when towed in a forward working direction of the grader vehicle. Although two embodiments of the roller assembly are shown in the accompanying figures, the common features of both will first be described herein.

The roller assembly 10 includes a main frame member 12 comprising a horizontally extending elongate I-beam which is supported perpendicularly to the forward working direction. A hitch member 14 is provided for attachment to the towing vehicle and is supported on the main frame member 12. A carriage, including suitable bushing material, rollers or mating smooth surfaces or the like, is provided between the hitch member 14 and the main frame member 12 to permit the hitch member to be slidable in a lateral direction along the main frame member.

A hydraulic cylinder 16 controls the position of the hitch member 14 relative to the main frame member 12 in a lateral direction perpendicular to the forward working direction. The hydraulic cylinder 16 is anchored at a cylinder end pivotally on one end of the frame member 12 by a suitable attachment member 18 and is supported pivotally at a piston end on the hitch member 14 so that extension and retraction of the hydraulic actuator 16 causes the main frame member 12 to be laterally displaced in relation to the hitch member 14 secured to the towing vehicle. Lateral positioning of the roller assembly 10 relative to the towing vehicle can thus be readily adjusted.

The main frame member 12 is provided with a pair of hitch stands 20 supported at opposing ends thereof. Each hitch stand comprises a telescoping post which extends downwardly from the main frame member to a foot 22 at a bottom end thereof for engaging the ground. The telescoping post includes cooperating apertures therein for receiving an adjustable locking pin 24 which selectively secures the telescoping post at various lengths for ether storing the post in a raised position or using the post in an extended position in which the main frame member 12 is supported spaced above the ground when the hitch member 14 is separated from the towing vehicle.

An auxiliary frame member 40 spans in the lateral direction alongside, parallel to, and spaced slightly rearwardly from the main frame member 12. The auxiliary frame member and the main frame member 12 are joined by end plates 58 which support the frame members in fixed relation to one another with a small gap therebetween so as not to interfere with sliding movement of the hitch member along the main frame member. The end plates 58 also support the hitch stands 20 at the opposing ends of the main frame member.

The assembly 10 includes a plurality of walking beams 26 which support a plurality of rollers 28 thereon for movement relative to the main frame member 12. The assembly also includes support arms 30 coupled to the auxiliary frame member 40 to extend rearwardly therefrom to support the walking beams 26 at the rear free ends of the support arms 30 with the support arms having sufficient length to locate all of the rollers 28 rearwardly of the main frame member and auxiliary frame member.

Each walking beam 26 comprises a rigid member which extends generally in the forward working direction between opposed ends 34 of the beams. Each beam includes a central pivot 36, centrally spaced evenly between the opposed ends 34, which pivotally supports the respective beam 26 on the support arms 30 for pivotal movement about a respective pivot axis which is oriented horizontally and perpendicular to the forward working direction. The free ends 34 of each beam are thus supported for generally upward and downward movement with pivoting movement of the beams about the respective pivot axis.

The rollers 28 are supported at each end 34 of the beams 26 with all of the rollers being positioned at an equal distance from the respective pivot axis of the beams. Each roller 28 is supported on the respective beam to be offset in a lateral direction from corresponding rollers supported at the opposing end of the same beam so that the track in the longitudinal direction of foremost ones of the rollers is adjacent but does not follow a common track with the tracks of rearmost ones of the rollers 28 supported at the opposing ends of the walking beams 26.

The rollers 28 are supported by suitable bearings for free rotation in relation to the respective beam 26 upon which they are supported. The rollers are rotatably supported about respective roller axes which are also perpendicular to the forward working direction. The pivots 26 of the walking beams 26 are also freely pivotal to permit free pivoting movement of the walking beams 26 relative to the main frame member 12.

The walking beams are supported on the main frame member 12 by the support arms 30 in a manner which allows upward and downward deflections of the central pivots of each walking beam 26 relative to some of the central pivots 36 of other ones of the walking beams by pivoting the support arms on the auxiliary frame member 40. This is accomplished by pivoting of the support arms relative to the frame members to accommodate for varying elevation and ground contours in a lateral direction from one walking beam to the next while maintaining the pivot axes thereof in a horizontal direction as the pivots are deflected upwardly and downwardly with the free ends of the support arms 30.

Accordingly the pivot axes of some of the walking beams are not in common with the pivots of other walking beams unless on horizontal and level terrain as the axes are also permitted to have some relative movement relative to one another. In this configuration the rollers 28 supported on the walking beams 26 are permitted to vary in elevation between foremost and rearmost ones of the rollers as well as being permitted to vary in elevation from one walking beam to each adjacent walking beam in a lateral direction.

More particularly, the support arms 30 are pivotally supported on the auxiliary frame member 40 at respective front ends of the support arms. In all, three supports arms are provided at evenly spaced positions in the lateral direction on the auxiliary frame member 12, with each support arm mounting a respective one of the walking beams 26 at the rear end thereof.

The central pivot 36 of each walking beam 26 is mounted directly below the free rear end of the respective support arm upon which it is supported so that the walking beam remains freely pivotal relative to the respective support arm.

The rollers 28 are supported in spaced apart pairs at each end of each beam 26 with the pair at the front ends of the beams being laterally offset from the pair at the rear end such one of the forward wheels aligns with the space between the rear wheels and one of the rear wheels aligns with the space between the front wheels. The walking beam spacing is selected so that all of the rollers together alternate in the lateral direction between the track of a foremost one of the rollers and a track of a rearmost one of the rollers.

The pivotal mounting of the support arms on the frame member permits the pivot 36 of each walking beam to be individually and independently deflected upwardly or downwardly in relation to all of the other pivots 36 and in relation to the main frame member.

A common hydraulic mechanism provides an even pressure distribution in the lateral direction between the different walking beams while the walking beam structure by itself already ensures even pressure distribution between forward and rearward rollers of the assembly. The combination of walking beams and even lateral pressure distribution by supporting the pivots of the walking beams for relative up and down movement while under hydraulic pressure results in a new and advantageous roller assembly which is both simple in construction while being highly flexible to accommodate multiple varying elevations and contours in the ground in both longitudinal and lateral directions.

The common hydraulic mechanism to provide even lateral pressure distribution involves a common hydraulic fluid circuit which provides a common downward hydraulic control pressure to each support arm 30. A hydraulic actuator 60 is associated with each support arm and includes a cylinder end mounted pivotally on the auxiliary frame member 12 directly thereabove and a piston end pivotally mounted on the respective support arm at a top side thereof spaced rearwardly from the pivotal connection of the support arm to the frame member.

Figure 4:
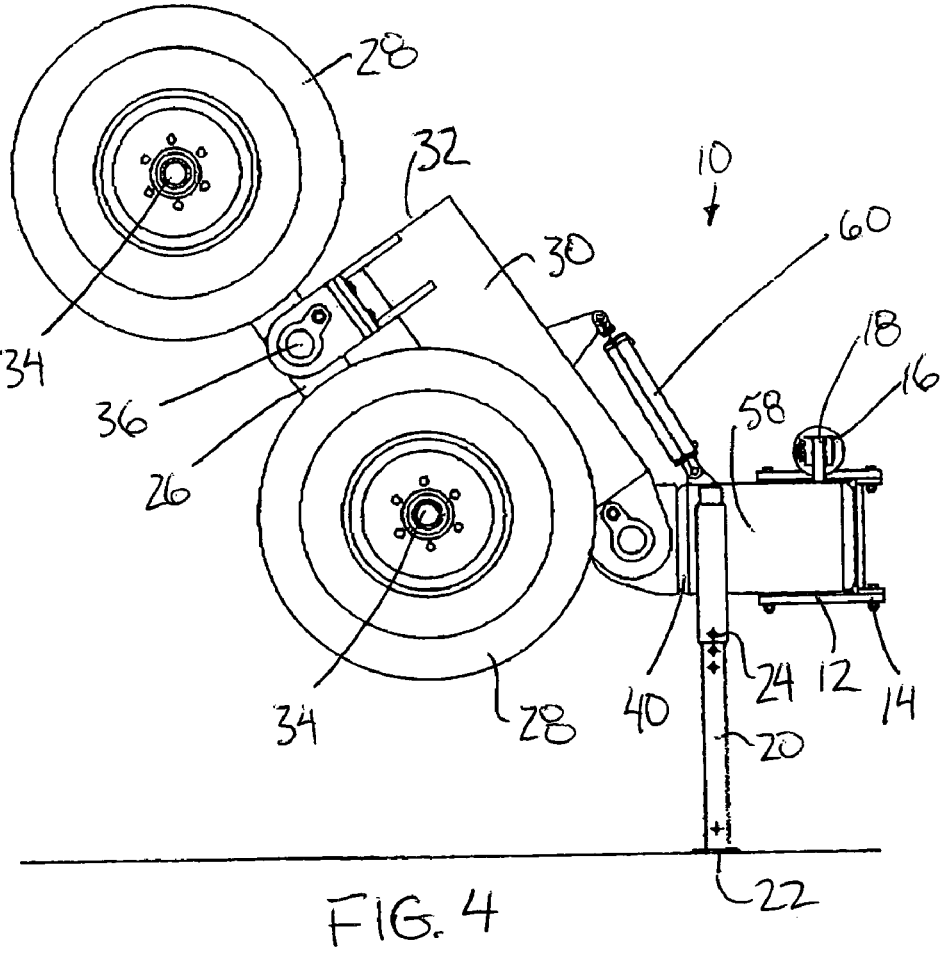
FIG. 4 and FIG. 5 are side elevational views of the assembly in lowered and raised positions respectively.
Figure 5:
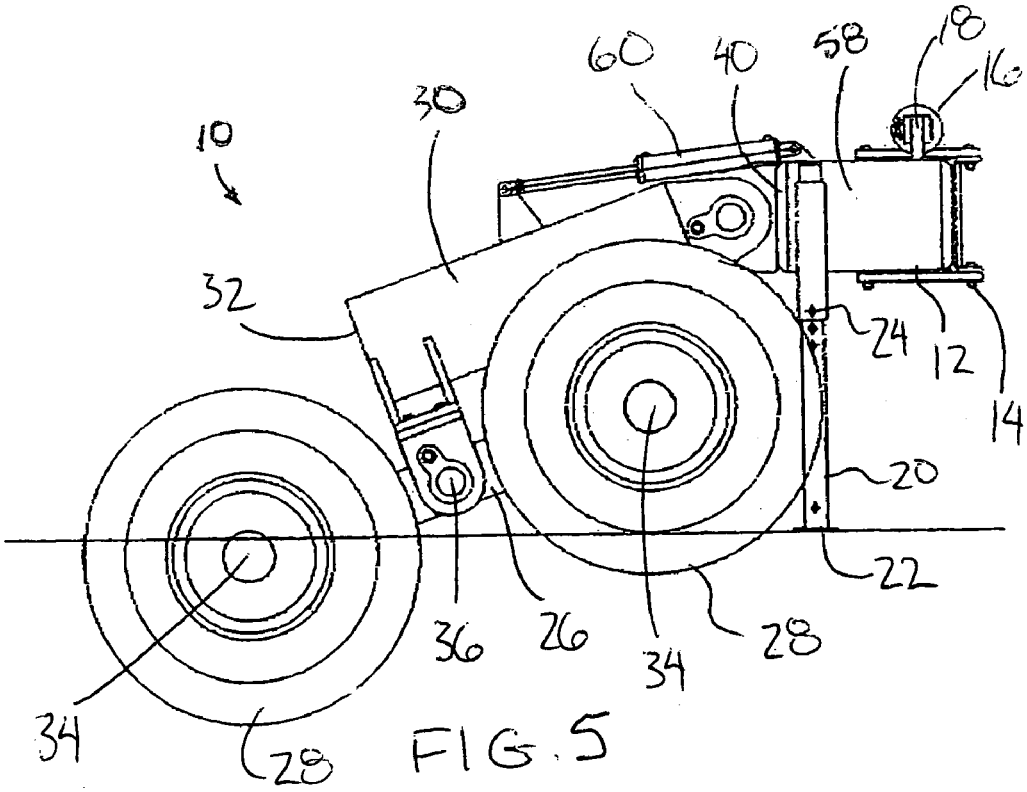

As shown in FIGS. 4 and 5, increased hydraulic pressure to the mounting end of each actuator cylinder can cause downward deflection of the support arms to apply greater downward pressure on the rollers of the packer assembly, while alternatively hydraulic pressure can be directed to the free rod end of the cylinders to retract the actuators and resulting cause upward deflection of the support arms relative to the main frame member for lifting the roller assembly and the rollers thereof off of the ground when not in use or for transport.

Figure 6:
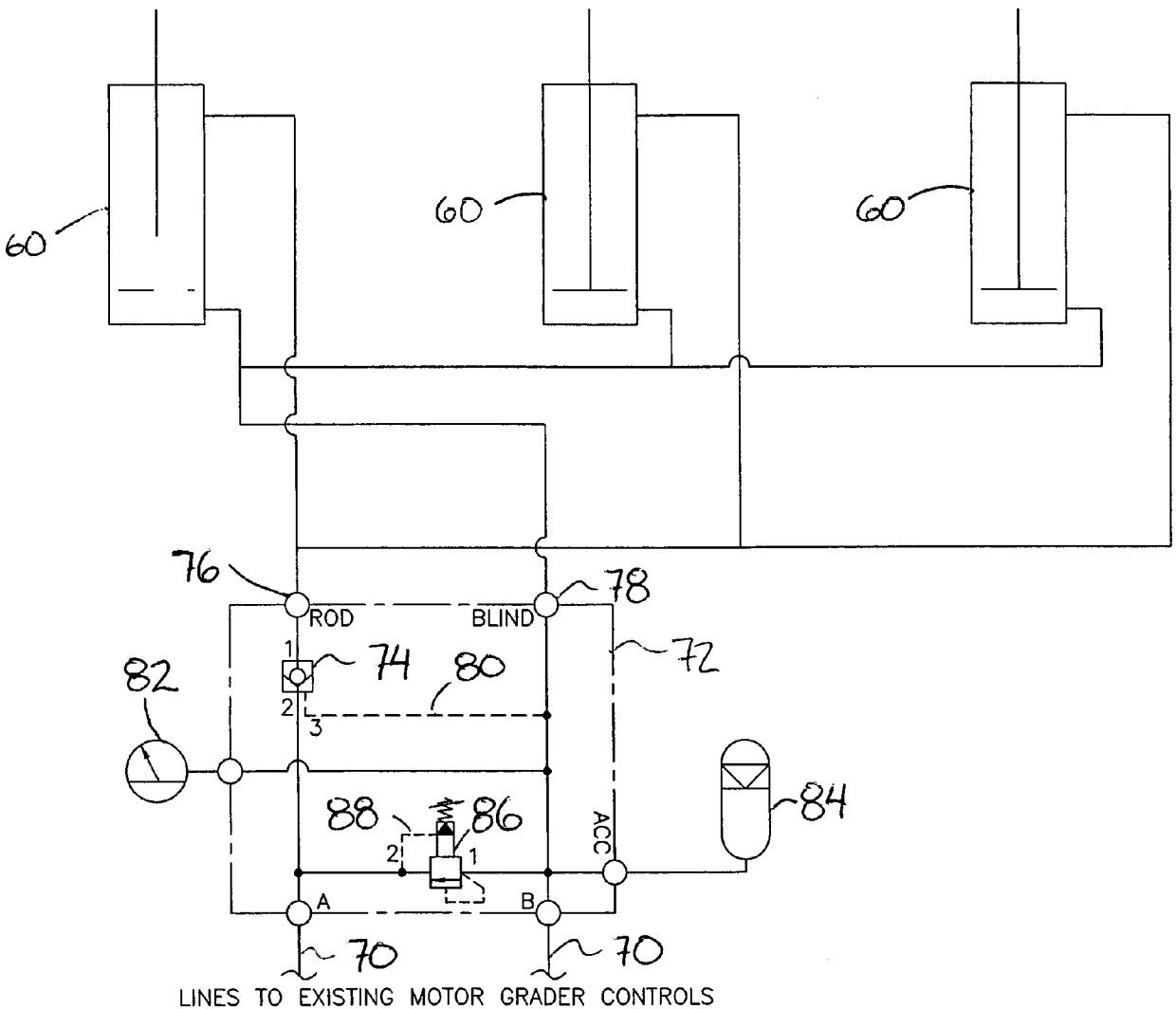
FIG. 6 is schematic representation of a hydraulic circuit for controlling the hydraulic actuators of the roller assembly.

Turning now to FIG. 6, the hydraulic circuit of the common hydraulic mechanism will now be described in further detail. The hydraulic circuit for the actuators 60 is independent of the circuit which controls the hydraulic actuator 16 of the sliding hitch member 14. The hydraulic circuit is arranged for connection to existing switched lines 70 of the hydraulic system of the towing vehicle. The two switched lines 70 are coupled to suitable hydraulic controls of the towing vehicle such that the lines are alternately connected to a hydraulic fluid pressure supply line and a pump return line respectively of the vehicle's hydraulic system.

When it is desirable to retract the actuators 60 to raise the apparatus as shown in FIG. 4, the switched lines are arranged to be connected so that fluid under pressure is supplied to port A of a control box 72 of the hydraulic circuit of the common hydraulic mechanism. Port A is connected through a check valve 74 to a lifting port 76 of the circuit which is commonly connected to the rod end of each cylinder of the actuators 60. Accordingly the pressure of the fluid causes the actuator 60 to retract. At the same time, port B of the circuit is arranged to be coupled to the pump return line of the grader controls. Port B communicates openly with a lowering port 78 which is in turn in open communication with all of the actuators at the mounted end of the cylinders. Fluid is thus freely permitted to drain from the mounting end of the cylinders back to the pump return line of the grader.

Alternatively when it is desired to lower the walking beams and apply pressure to the rollers against a surface to compacted, the switched lines 70 are arranged using the vehicle's controls so that supply pressure is provided to port B while port A of the hydraulic circuit is coupled to the pump return line. Accordingly pressure is delivered to the lowering port 78 while the lifting port 76 drains to the pump return line of the grader.

A pilot line 80 is coupled in communication with the hydraulic line extending between port B and the lowering port 78 so that whenever supply pressure is provided to lower the walking beam by extending the actuators, pressure in the pilot line 80 causes the check valve 74 to be released so that pressure can be drained from the rod end of the cylinders back to the port A and the pump return line.

A pressure gauge 82 is also coupled in communication with the hydraulic line between port B and the lowering port 78 to monitor the pressure of hydraulic fluid being applied during extension of the actuators 60 to apply downward force to the walking beams. The downward force applied to the walking beams and in turn the rollers thus comprises a common hydraulic fluid pressure which remains common to all actuators 60 throughout their relative movement due to the open hydraulic communication therebetween.

A hydraulic fluid accumulator 84 is also coupled to the hydraulic line communicating to the lowering port 78. In the event of small obstacles being encountered which provide upward force to the rollers of the walking beams, the resulting small surges in hydraulic pressure are relieved by permitting some fluid to accumulate within the accumulator 84 against the force of a biased diaphragm or piston type arrangement. The accumulator 84 thus only receives fluid therein when the hydraulic pressure exceeds a first prescribed relief pressure. Once the disturbance causing the elevated pressure has passed, fluid is returned under pressure from the accumulator 84 back to the actuators through the lowering ports 78.

A pressure relief mechanism 86 is also coupled to the hydraulic line communicating to the lowering port 78 to permit hydraulic pressure to be dumped from port B and the lowering port 78 to port A which is connected to the pump return line when in use during a packing operation. The pressure relief valve is arranged to only relieve fluid back to the return line of the hydraulic pump when a second prescribed relief pressure is reached which is greater than the first prescribed relief pressure of the accumulator 84. A pilot line 88 is coupled to port A of the hydraulic circuit for resetting the pressure relief valve 86 when the switched lines 70 are reversed so that supply pressure is provided to port A for raising the walking beams and port B is coupled to the pump return line of the grader.

In this arrangement a common hydraulic fluid pressure is applied to each pivot of each walking beam. Open communication between the actuators 60 ensures that pressure remains commonly delivered to all of the walking beams. If one of the beams encounters an elevated ground contour for instance, hydraulic pressure is automatically transferred to the other actuators in a manner which causes them to be further extended, thus lowering the other walking beams in relation to the walking beam which has encountered the elevated obstacle.

If the collective elevation of the walking beams suddenly is raised, the pressure accumulator 84 will accommodate a first elevated pressure condition temporarily, while if an even greater elevated condition arises to further raise the fluid pressure beyond the second prescribed relief pressure, the pressure relief valve will then be actuated for commonly relieving pressure to all of the actuators when actuated. Similarly by commonly connecting the hydraulic fluid accumulator 84 to all of the actuators, the accumulator commonly receives hydraulic fluid from the actuators when it is activated.

Figure 7:
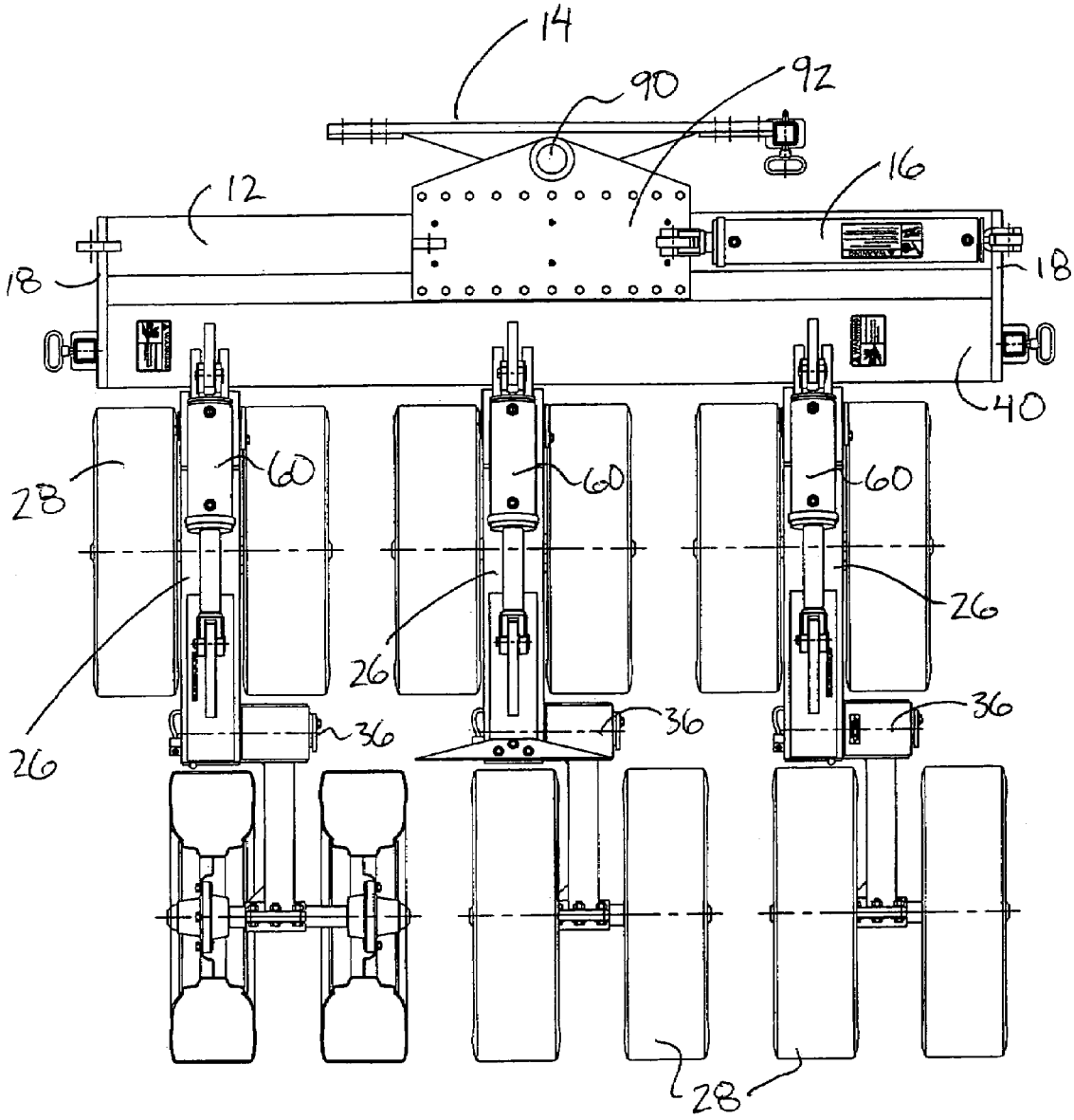
FIG. 7 is a top plan view of an alternate embodiment of the roller assembly.
Figure 8:
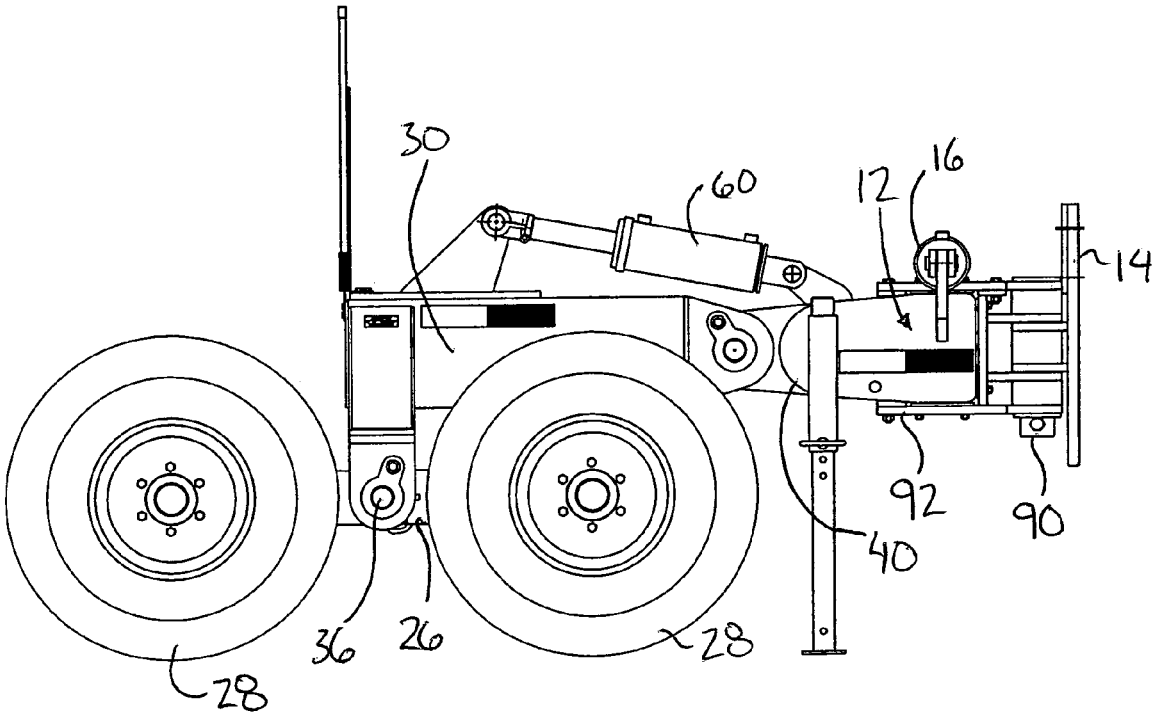
FIG. 8 is a side elevational view of the roller assembly according to FIG. 7.

Turning now to the embodiment of FIGS. 7 and 8, the hitch member 14 in this instance is coupled to the main frame member 12 both for lateral sliding movement along the frame member as well as pivotal movement about a vertical steering pivot 90. The vertical steering pivot 90 couples the frame member 12 for relative pivotal movement about a vertical pivot axis in relation to the hitch member 14 which connects to the towing vehicle so that the apparatus 10 is in turn steerable about the vertical axis relative to the towing vehicle. The vertical steering pivot 90 is coupled between the mounting plate of the hitch member 14 which connects to the towing vehicle and a carriage 92 slidable along the main frame member 12 to support the hitch member 14 for lateral sliding movement along the frame member.

The hydraulic actuator 16 in this embodiment also controls the position of the carriage 92, and in turn the hitch member 14 coupled thereto, along the main frame member 12. By supporting the vertical steering pivot between the carriage 92 and the hitch member 14, the vertical steering pivot is also slidable in the lateral direction along the main frame member 12 so that the walking beams and rollers supported thereon can be offset laterally in relation to the steering pivot 90 in use. The remaining configuration of the support arms 30 coupled to the auxiliary frame member 40 and supporting the walking beams 26 thereon in this embodiment are substantially identical to the embodiment of the FIGS. 1 through 6.

In yet further variants of the roller assembly, each of the walking beams may be supported for pivotal movement about respective vertical axes for steering the assembly about corners and the like. Each of the walking beams 26 may be pivoted about a respective vertical axis by coupling the respective support arm 30 on the frame member 40 for relative pivotal movement about a vertical axis so that the walking beams can swing side to side in either lateral direction relative to the frame member. Pivoting movement of the support arms on the frame member permit the walking beams to freely pivot in a trailing movement behind the frame member, or alternatively, movement of the walking beams about the respective vertical axes may be controlled. This movement may be controlled by providing individual hydraulic actuators between each support arm and the frame member or by simply interconnecting the support arms by pivoting links to maintain the lateral spacing between the support arms with or without additional hydraulic control.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A roller assembly for movement along the ground in a forward working direction; the assembly comprising:

a frame member extending transversely to the forward working direction;

a plurality of walking beams, each walking beam extending generally in the forward working direction between opposed ends;

a roller rotatably supported at each end of each walking beam so as to be arranged for rotation about respective roller axes and arranged for rolling movement along the ground in the forward working direction;

a pivot on each walking beam between the rollers at the opposed ends of said walking beam pivotally supporting the walking beam so as to be arranged for pivotal movement of the walking beam relative to the frame member about a respective generally horizontal pivot axis oriented transversely to the forward working direction;

each of the rollers being arranged for rotation relative to the respective walking beam about a respective roller axis at a location spaced from the pivot axis of the walking beam; and a support mechanism supporting the pivots between the rollers at opposed ends of the walking beams on the frame member such that each of said pivots is movable generally upwardly and downwardly relative to the other ones of said pivots.

2. The roller assembly according to claim 1 wherein the support mechanism is arranged to support the pivot axes of the pivots in a horizontal orientation through upward and downward movement of the pivots relative to one another.

3. The roller assembly according to claim 1 wherein the support mechanism includes a hydraulic system for applying a common downward hydraulic pressure to the pivots of the walking beams.

4. The roller assembly according to claim 3 wherein the hydraulic system is arranged to commonly raise the pivots of the walking beams relative to the frame member.

5. The roller assembly according to claim 1 wherein there is provided a hitch member arranged to connect to a towing vehicle and a steering pivot coupling the frame member to the hitch member for relative pivotal movement of the frame member relative to the hitch member about a generally vertical steering axis.

6. The roller assembly according to claim 5 wherein the vertical steering pivot is coupled to the main frame member for relative sliding movement in a lateral direction and wherein there is provided a hydraulic actuator coupled between the steering pivot and the frame member for controlling relative sliding movement therebetween in the lateral direction transversely to the forward working direction.

7. A roller assembly for movement along the ground in a forward working direction; the assembly comprising:

a frame member extending transversely to the forward working direction;

a plurality of walking beams, each walking beam extending generally in the forward working direction between opposed ends;

a roller rotatably supported at each end of each walking beam so as to be arranged for rotation about respective roller axes relative to the walking beam and arranged for rolling movement along the ground in the forward working direction;

a pivot on each walking beam between the rollers at the opposed ends of said walking beam pivotally supporting the walking beam so as to be arranged for pivotal movement of the walking beam relative to the frame member about a respective generally horizontal pivot axis oriented transversely to the forward working direction;

each of the rollers being arranged for rotation relative to the respective walking beam about a respective roller axis at a location spaced from the pivot axis of the walking beam;

a support mechanism supporting the pivots between the rollers at opposed ends of the walking beams on the frame member such that each of said pivots is supported so as to be arranged for independent upward and downward movement relative to the other ones of said pivots; and a hydraulic system arranged to apply a downward hydraulic pressure to each of said pivots of the walking beams such that the pivots of the walking beams remain movable upwardly and downwardly relative to the frame member independently of one another.

8. The roller assembly according to claim 7 wherein the support mechanism is arranged to support the pivot axes of the pivots in a horizontal orientation through upward and downward movement of the pivots relative to one another.

9. The roller assembly according to claim 7 wherein there is provided a plurality of rollers supported at each end of each walking beam and wherein all of the rollers are offset from one another in a lateral direction.

10. The roller assembly according to claim 7 wherein the support mechanism comprises a support arm associated with each walking beam, the support arm being pivotally supported on the frame member at a front end and supporting the pivot of the respective walking beam thereon spaced rearward from the front end.

11. The roller assembly according to claim 10 wherein there is provided a hydraulic actuator associated with each support arm for applying a downward force of hydraulic pressure to each pivot of each walking beam.

12. The roller assembly according to claim 11 wherein the actuators are provided with a common hydraulic pressure.

13. The roller assembly according to claim 11 wherein the actuators are commonly coupled in communication with a common hydraulic fluid accumulator arranged to commonly receive hydraulic fluid from the actuators when actuated.

14. The roller assembly according to claim 11 wherein the actuators are commonly coupled in communication with a common pressure relief mechanism arranged to commonly release pressure to all of the actuators when actuated.

15. The roller assembly according to claim 7 wherein there is provided a hitch member arranged to connect to a towing vehicle and a steering pivot coupling the frame member to the hitch member for relative pivotal movement of the frame member relative to the hitch member about a generally vertical steering axis.

16. The roller assembly according to claim 15 wherein the vertical steering pivot is coupled to the main frame member for relative sliding movement in a lateral direction and wherein there is provided a hydraulic actuator coupled between the steering pivot and the frame member for controlling relative sliding movement therebetween in the lateral direction transversely to the forward working direction.

17. A roller assembly for movement along the ground in a forward working direction; the assembly comprising:

a frame member extending transversely to the forward working direction;

a plurality of walking beams, each walking beam extending generally in the forward working direction between opposed ends;

a roller rotatably supported at each end of each walking beam so as to be arranged for rotation about respective roller axes relative to the walking beam and arranged for rolling movement along the ground in the forward working direction;

a pivot on each walking beam between the rollers at the opposed ends of said walking beam pivotally supporting the walking beam so as to be arranged for pivotal movement of the walking beam relative to the frame member about a respective generally horizontal pivot axis oriented transversely to the forward working direction;

each of the rollers being arranged for rotation relative to the respective walking beam about a respective roller axis at a location spaced from the pivot axis of the walking beam;

a support mechanism supporting the pivots between the rollers at opposed ends of the walking beams on the frame member such that each of said pivots is supported so as to be arranged for upward and downward movement relative to the other ones of said pivots; and a hydraulic system comprising a hydraulic actuator associated with each walking beam and arranged to apply a downward hydraulic pressure to the pivot of the walking beam;

the hydraulic actuators being in open communication with one another such that the hydraulic system is arranged to communicate a common hydraulic pressure to all of the walking beams.

18. The roller assembly according to claim 17 wherein the actuators are commonly coupled in communication with a common hydraulic fluid accumulator arranged to commonly receive hydraulic fluid from the actuators when actuated.

19. The roller assembly according to claim 17 wherein the actuators are commonly coupled in communication with a common pressure relief mechanism arranged to commonly release pressure to all of the actuators when actuated.

20. The roller assembly according to claim 17 wherein there is provided a plurality of rollers supported at each end of each walking beam and wherein all of the rollers are offset from one another in a lateral direction.

* * * * *